US007854100B2

(12) United States Patent
Pervan et al.

(10) Patent No.: US 7,854,100 B2
(45) **Date of Patent: *Dec. 21, 2010**

(54) LAMINATE FLOOR PANELS

(75) Inventors: Darko Pervan, Viken (SE); Christian Boo, Kågeröd (SE); Mattias Sjöstrand, Helsingborg (SE); Tony Pervan, Stockholm (SE)

(73) Assignee: Valinge Innovation AB, Viken (SE)

( * ) Notice: Subject to any disclaimer, the term of this patent is extended or adjusted under 35 U.S.C. 154(b) by 591 days.

This patent is subject to a terminal disclaimer.

(21) Appl. No.: 11/635,633

(22) Filed: Dec. 8, 2006

(65) Prior Publication Data

US 2007/0175143 A1 Aug. 2, 2007

Related U.S. Application Data

(60) Provisional application No. 60/759,589, filed on Jan. 18, 2006.

(30) Foreign Application Priority Data

Jan. 12, 2006 (SE) ..... 0600062

(51) Int. Cl.
*E04B 5/00* (2006.01)

(52) U.S. Cl. ..... 52/586.1; 52/177; 52/589.1; 52/747.1

(58) Field of Classification Search ..... 52/403.1, 52/578, 589.1, 590.2, 480, 506.1, 586.2, 52/584.1, 592.2, 551, 579, 581, 586.1, 177, 52/747.1

See application file for complete search history.

(56) References Cited

U.S. PATENT DOCUMENTS

| | | | |
|---|---|---|---|
| 2,497,837 | A | 2/1950 | Nelson |
| 2,740,167 | A | 4/1956 | Rowley |
| 3,200,553 | A | 8/1965 | Frashour et al. |
| 3,347,048 | A | 10/1967 | Brown et al. |
| 4,426,820 | A | 1/1984 | Terbrack et al. |
| 5,425,986 | A | 6/1995 | Guyette |
| 5,560,569 | A | 10/1996 | Schmidt |
| 5,899,251 | A | 5/1999 | Turner |
| 5,985,398 | A | 11/1999 | Bellegarde |
| 6,189,283 | B1 | 2/2001 | Bentley et al. |
| 6,421,970 | B1 | 7/2002 | Martensson et al. |

(Continued)

FOREIGN PATENT DOCUMENTS

| | | |
|---|---|---|
| DE | 2 159 042 | 6/1973 |

(Continued)

OTHER PUBLICATIONS

International Search Report for PCT/SE 03/00641, mailed Aug. 14, 2003.

(Continued)

*Primary Examiner*—Richard E Chilcot, Jr.
*Assistant Examiner*—Chi Nguyen
(74) *Attorney, Agent, or Firm*—Buchanan Ingersoll & Rooney PC

(57) ABSTRACT

Floor panels (2) are shown with a discontinuous surface (31) layer and core (30), which are mechanically connectable to each other along one pair of adjacent edges, said floor panels comprising at least two floor elements (1, 1'), which are connected with glue.

25 Claims, 6 Drawing Sheets

U.S. PATENT DOCUMENTS

| | | | |
|---|---|---|---|
| 6,536,178 | B1 | 3/2003 | Palsson et al. |
| 6,729,091 | B1 | 5/2004 | Martensson |
| 6,763,643 | B1 | 7/2004 | Martensson |
| 6,769,218 | B2 | 8/2004 | Pervan |
| 2004/0045254 | A1 | 3/2004 | Van Der Heijden |
| 2004/0139678 | A1 | 7/2004 | Pervan |
| 2007/0175156 | A1 | 8/2007 | Pervan et al. |
| 2008/0005989 | A1 | 1/2008 | Pervan et al. |
| 2008/0005997 | A1 | 1/2008 | Pervan |
| 2008/0005998 | A1 | 1/2008 | Pervan |
| 2008/0041007 | A1 | 2/2008 | Pervan et al. |
| 2008/0168736 | A1 | 7/2008 | Pervan |
| 2008/0209837 | A1 | 9/2008 | Pervan |
| 2008/0209838 | A1 | 9/2008 | Pervan |

FOREIGN PATENT DOCUMENTS

| | | | |
|---|---|---|---|
| DE | 33 43 601 | A1 | 6/1985 |
| DE | 296 18 318 | U1 | 5/1997 |
| DE | 197 18 319 | A1 | 11/1998 |
| DE | 197 18 812 | A1 | 11/1998 |
| FR | 2 690 650 | A1 | 11/1993 |
| JP | 7-300979 | | 11/1995 |
| WO | WO 97/47834 | A1 | 12/1997 |
| WO | WO 00/20705 | A1 | 4/2000 |
| WO | WO 00/66856 | A1 | 11/2000 |
| WO | WO 01/66877 | A1 | 9/2001 |
| WO | WO 02/055809 | A1 | 7/2002 |
| WO | WO 02/055810 | A1 | 7/2002 |
| WO | WO 03/025307 | A1 | 3/2003 |
| WO | 03/089736 | A1 | 10/2003 |

OTHER PUBLICATIONS

International Search Report issued in PCT/SE2006/001403 (Published as WO 2007/081255 A1), Mar. 1, 2007, Swedish Patent Office, Stockholm, SE.

International Preliminary Report on Patentability issued in PCT/SE2006/001403 (Published as WO 2007/081255 A1), Jul. 15, 2008, IB of WIPO, Geneva, CH.

Written Opinion issued in PCT/SE2006/001403 (Published as WO 2007/081255 A1), Mar. 1, 2007, ISA/SE— Patent-och registreringsverket, Stockholm, SE.

LAMINATE FLOOR PANELS

CROSS REFERENCE TO RELATED APPLICATIONS

The present application claims the benefit of U.S. Provisional Application No. 60/759,589, filed in the U.S. on Jan. 18, 2006, the entire contents of which is incorporated herein by reference.

TECHNICAL FIELD

The invention generally relates to the field of flooring systems comprising laminated floor panels, which could be installed in advanced patterns especially such floor panels, which are possible to lock and unlock with mechanical locking systems. The invention concerns an improvement of the flooring system and panels described in WO 03/089736, which is incorporated as reference.

FIELD OF APPLICATION

The present invention is particularly suitable for use in floating floors, which are not attached to the sub floor and which are formed of floor panels joined mechanically with a locking system integrated with the floor panel, i.e. mounted at the factory, are made up of one or more upper layers of printed and structured materials such as decorative laminate or decorative plastic material, an intermediate core of wood fibre based material or plastic material and preferably a lower balancing layer on the rear side of the core. The following description of known techniques, problems of known systems and objects and features will therefore, as a non restrictive example, be aimed above all at this field of application and in particular laminate flooring.

It should be emphasised that the invention can be used in any floor panel and it could be combined with all types of known locking system, where the floor panels are intended to be joined using a mechanical locking system connecting the panels in the horizontal and vertical directions on at least two adjacent sides. The invention can thus also be applicable to, for instance, solid wooden floors, parquet floors with a core of wood or wood fibre based material and a surface of wood or wood veneer and the like, floors with a printed and preferably also varnished surface, floors with a surface layer of plastic or cork, linoleum, rubber or similar. Even floors with hard surfaces such as stone, tile and similar materials are included and floorings with soft wear layer, for instance needle felt glued to a board. The principle could also be used on floors, which are glued or nailed to the sub floor.

BACKGROUND

Laminate flooring usually comprising rectangular floor panels with a core of a 6-12 mm fibre board, a 0.2-0.8 mm thick upper decorative surface layer of laminate and a 0.1-0.6 mm thick lower balancing layer of laminate, plastic, paper or like material. A laminate surface comprises a printed melamine impregnated paper, which is pressed with an embossed sheet. The most common core material is fibreboard with high density and good stability usually called HDF—High Density Fibreboard. Sometimes also MDF—Medium Density Fibreboard—is used as core.

Traditional laminate floor panels of this type have taken a large market share mainly due to the fact that advanced printing and pressing technology has made it possible to make very natural copies of mainly wood parquet floorings. Laminate floorings look like wood, but are more durable and less expensive than wood floorings.

In addition to such traditional floors, which have been installed with a tongue and groove joint and with glue, floor panels have been developed which do not require the use of glue and instead are joined mechanically by means of so called mechanical locking systems.

These systems comprise locking means, which lock the panels horizontally and vertically. The mechanical locking systems are usually formed by machining of the core of the panel. Alternatively, parts of the locking system can be formed of a separate material, for instance aluminium or HDF, which is integrated with the floor panel, i.e. joined with the floor panel in connection with the manufacture thereof.

The main advantages of floating floors with mechanical locking systems are that they are easy to install. They can also easily be taken up again and used once more at a different location.

Definition of Some Terms

By "horizontal plane or principal plane" is meant a plane, which extends parallel to the outer part of the surface layer. Immediately juxtaposed upper parts of two adjacent joint edges of two joined floor panels together define a "vertical plane (V)" perpendicular to the horizontal plane. By "horizontally" is meant parallel to the horizontal plane and by "vertically" parallel to the vertical plane By "locking systems" are meant co acting connecting means, which connect the floor panels vertically and/or horizontally. By "mechanical locking system" is meant that joining can take place without glue.

By a "discontinuous surface layer and core" is meant the surface layer and core of two elements connected to each other to form one panel or two panels connected to each other to form a floor and consequently the core and surface layer of the connected elements and the panels respectively is discontinuous. A joint is detectable between the two elements or panels at the discontinuity.

Known Techniques and Problems Thereof

Printing and pressing technology have in recent years been developed further and very natural copies of stone, tiles and parquet strips have been introduced on the market.

There are however a lot of designs and patterns which are not possible to produce and install with the present printing, pressing and mechanical locking technology.

Most designs which contain patterns or structures where parts have to be aligned with the format of the floor panel are difficult to produce since swelling and shrinking of the printed paper and the positioning of the printing paper and the press sheet are difficult to control. Joints that cross a specific pattern, with parts designed to be one unit, give an unnatural appearance.

It is known that some advanced patterns could be produced with individual rectangular small floor panels, which could be connected to floor units. Such patterns and floor panels are described in WO 03/089736. This known technology has the disadvantage that the connection between the floor panels is expensive and complicated to produce, especially when a floor unit comprises several small panels. It would be a great advantage if individual floor elements could be produced and connected to larger floor panels in more cost efficient way.

OBJECTS AND SUMMARY

A first overall objective of the present invention is to provide a flooring system and floor panels, preferably with mechanical locking systems, which could be installed in advanced patterns and where the pattern to a large extent is obtained by the size, shape and mechanical working of the panels and not only by printing and pressing technology. A limited range of semi-finished boards could be machined into floor elements and combined to a wide range of new floor panels. This could be accomplished without changing the printing cylinders and press plates.

More specifically an object is to provide floor panels with a mechanical locking system where one or several of the following advantages are obtained.

The floor panel should preferably be possible to assemble mechanically to a floor surface which generally only could be obtained with small individual wood, tile or stone pieces with different sizes and structures and with panels, which are not floating but glued or nailed to the sub floor The floor panels should be easy to install in spite of the fact that the floor pattern could comprise a lot of small floor panels with different sizes and advanced shapes which differ from the traditional rectangular floor panels based on the same print and pressing plates.

The substantial waste, which is required in order to produce floor panels and mechanical locking systems in floors comprising small floor panels, should be reduced as much as possible The above objects of the invention are achieved wholly or partly by embodiments of the mechanical locking systems and floor panels described herein.

According to one embodiment of the invention, a flooring system, comprising a plurality of floor panels is provided. The floor panels comprise a discontinuous core having a core joint and a discontinuous surface layer having a surface joint. The floor panels are mechanically connectable to each other along one pair of adjacent edges and comprising at least two floor elements which are connected to each other with glue and that the surface joint is adjacent to the core joint.

The floor elements are factory connected to a floor panel and delivered as floor panels preferably in a package to the installation place as parts of a pre installed floor.

A floor panel, which is formed of several individual floor elements, offers a lot of advantages. Patterns could be created which are not possible to produce with printing or linear machining of the edges. Installation is easy since several floor elements could be installed at the same time. An essential feature of the invention is that joint between the floor elements could be rather simple, inexpensive and strong since the floor elements are connected with glue in the factory where suitable equipment could be used. A lot of very compact preferably glue based tongue and groove connections could be used and the waste could be reduced considerably.

The floor is to a large extent pre-installed at the factory and the individual elements could be connected to each other in a very efficient way. A lot of time consuming and difficult installation work where the floor installer has to work close to the floor, could be moved to a controlled factory environment.

BRIEF DESCRIPTION OF THE DRAWINGS

FIGS. 1*a*-4*b* illustrate prior art locking systems.

FIGS. 4*c*-5 illustrate a first embodiment of the invention

DESCRIPTION OF EMBODIMENTS OF THE INVENTIONS

To facilitate understanding, several floor panels and locking systems in the figures are shown schematically. It should be emphasised that improved or different functions can be achieved using combinations of the preferred embodiments. The inventor has tested all known and especially all commercially used locking systems on the market in all type of floor panels, especially laminate and wood floorings and the conclusion is that at least all these known locking systems which have one or more tongues and grooves or locking elements cooperating with locking grooves could be used to connect floor elements with glue to a floor panel and to connect the floor panels to a floor with a mechanical locking system.

Angles, dimensions, rounded parts etc are only examples and could be adjusted within the principles of the invention.

Figure 1A:
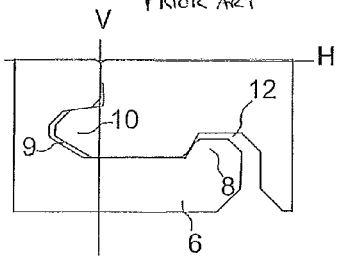
Fig. 1a PRIOR ART
Figure 1B:
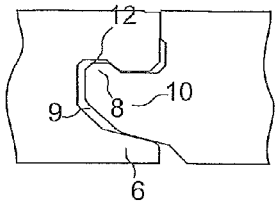
Fig. 1b PRIOR ART
Figure 1C:
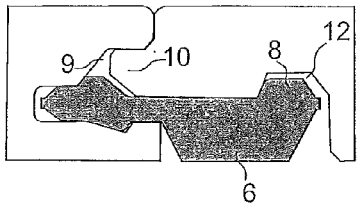
Fig. 1c PRIOR ART

FIGS. 1*a*-1*c* show known mechanical locking systems, which could be locked with angling and/or snapping. These locking systems have a tongue 10 and a groove 9 for vertical locking of adjacent edges parallel to the vertical plane V and a locking groove 12 and a locking element 8 for horizontal locking parallel with the horizontal plane H. The locking element could be located on a tongue 10 or a strip 6. These locking systems are very suitable to use in floor panels according to embodiments of the invention.

Figure 2A:
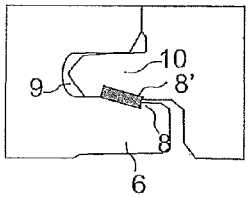
Fig. 2a PRIOR ART
Figure 2B:
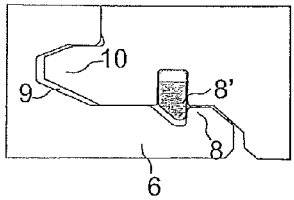
Fig. 2b PRIOR ART
Figure 2C:
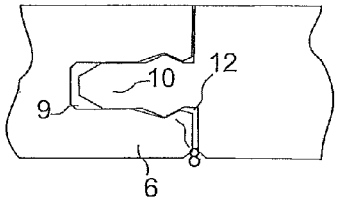
Fig. 2c PRIOR ART

FIGS. 2*a*-2*c* show mechanical locking systems, which could be locked by horizontal snapping. The locking elements could be made in one piece with the core as in FIG. 2*c* or of a separate material, hereafter referred to as two piece snap, as in FIGS. 2*a* and 2*b*. These snap systems have a low snapping resistance and a high locking strength and are therefore also very suitable to use in floor panels according to the invention.

Figure 3A:
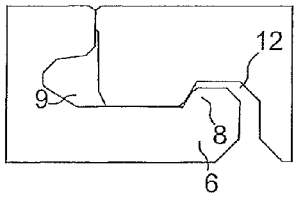
Fig.3a PRIOR ART
Figure 3B:
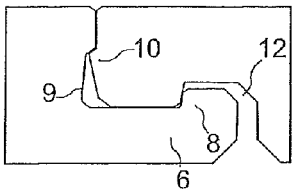
Fig. 3b PRIOR ART
Figure 3C:
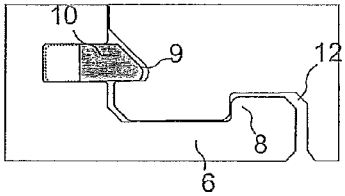
Fig. 3c PRIOR ART

FIGS. 3*a*-3*c* show mechanical locking systems which could be locked by a vertical folding. Such systems could have means for horizontal locking only, as in FIG. 3*a*, or they could have a small tongue 10 made in one piece, as in FIG. 3*b*. Alternative the tongue 10 could be flexible as in FIG. 3*c*. Such vertical folding with a tongue, which is displaceable horizontally, is very suitable to use in the floor panels according to the invention. Such systems are referred to a flex tongue systems.

Figure 4A:
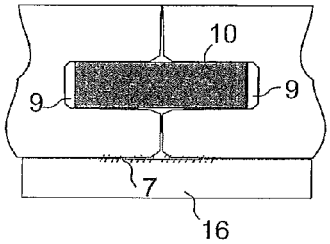
Fig. 4a PRIOR ART
Figure 4B:
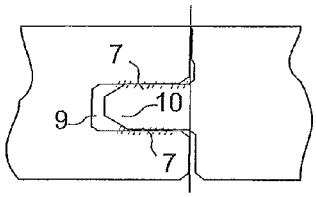
Fig. 4b PRIOR ART
Figure 4C:
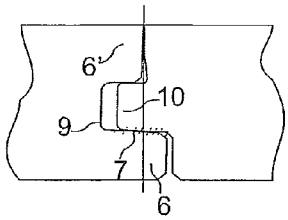

FIGS. 4*a*-4*b* show traditional locking systems, which are locked vertically with a tongue 10 and a groove 9 and horizontally with glue 7. FIG. 4*c* shows how a tongue and groove joint could be adjusted to be used in a factory connection of floor elements. The tongue 10 has been made smaller since special glue with controlled equipment could be used. The under lip 6 has been made slightly longer and extends beyond the upper lip 6'. This simplifies the application of glue and the under lip 6 could be formed such that it creates a vertical pre tension and keeps the floor element together until the glue cures.

Figure 5:
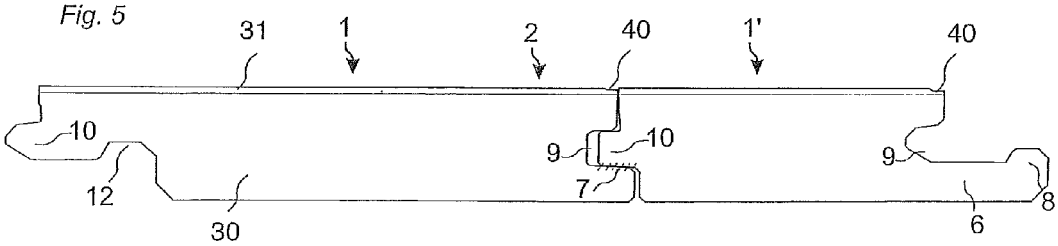

FIG. 5 illustrates schematically a cross section of a floor panel 2 according to one embodiment of the invention, which comprises two separate floor elements 1, 1', which have been factory connected with a tongue and groove locking system. The floor panel 2 has a surface layer 31 and a core 30, which are discontinuous, and edges, which in this preferred embodiment could be locked with angling. The floor elements have a decorative groove 40, bevel or similar on one edge. When floor elements are connected to floor panels very advance groove patterns could be obtained which are not possible to produce in a cost efficient way if they are to be made in an individual traditional floor panel.

Figure 6A:
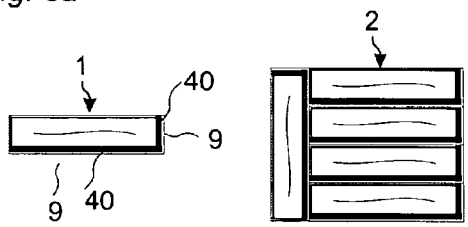
FIGS. 6*a*-10*c* illustrate further embodiments of the invention.

All these locking systems could be used in various combinations to connect floor panels according to embodiments of the invention. Mechanical locking systems could be adjusted to lock, for example, floor elements with a simple compact snap system, which only holds the panels together until the glue cures. Preferred embodiments to connect floor elements are locking systems, which are only using glue, since the panels could easily be positioned correctly horizontally to each other in the factory and generally no horizontal connection is needed. Floor elements could also be connected with tape on the rear side or glued to a underlay 16 which could be a foam, a cork layer, various types of plastic materials, wood based sheet materials or wood veneer or similar materials. Such connections are to be considered as a glue connection FIG. 6*a* shows a rectangular floor element 1, which is connected with several similar floor elements to form a floor panel 2. The floor elements could have a surface of the same material, for example laminate, but they could also have a surface layers of different materials for example laminate-wood, plastic material-laminate, Cork—wood etc. More than two different materials could be combined. The floor elements have decorative grooves 40 on two edges.

Figure 6B:
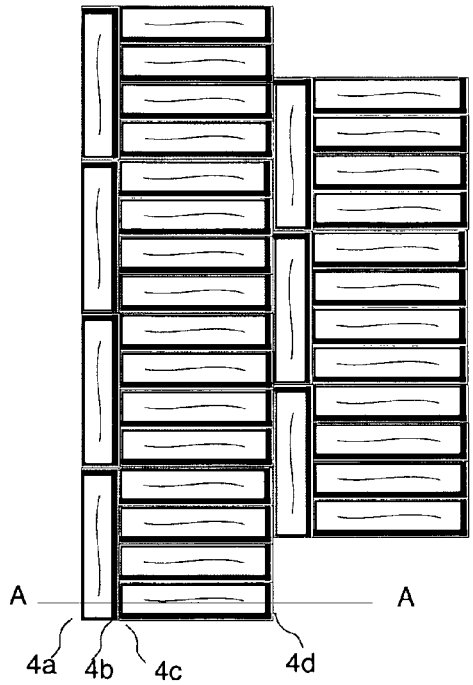

FIG. 6*b* show how floor panels 2 could be installed to a floor with combinations of angling, snapping and vertical folding.

Figure 6C:
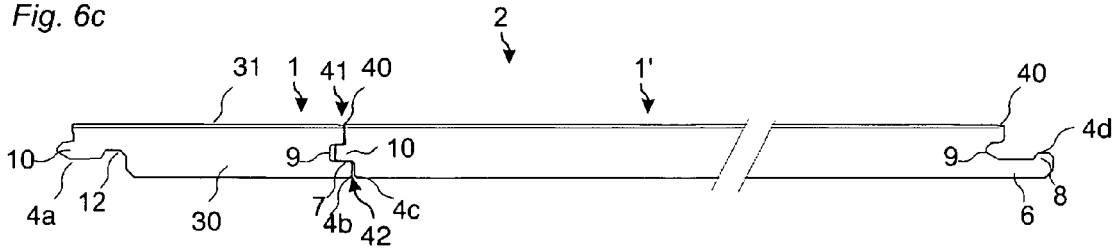

FIG. 6*c* shows a cross section along the line A-A in FIG. 6*b*. The floor elements 1, 1' have two edges 4*a*, 4*d*, which could be connected mechanically with angling and two edges 4*b*, 4*c* which could be connected with a compact glued 7 tongue 10 and groove 9 joint. The other two opposite edges of the floor panel are preferably provided with an angling locking system or a flex tongue system.

It is also obvious that all embodiments could be used to provide a floor where the floor panels are made of a single floor element. Practical testing shows however that a floor panel comprising five floor elements could be installed in advanced or complex patterns, e.g., different sizes of floor elements, more than five times faster than if the floor was installed with floor panels comprising only one floor element.

Figure 7A:
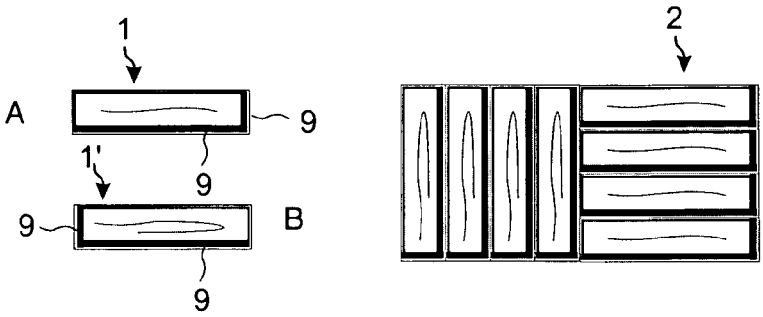
Figure 7B:
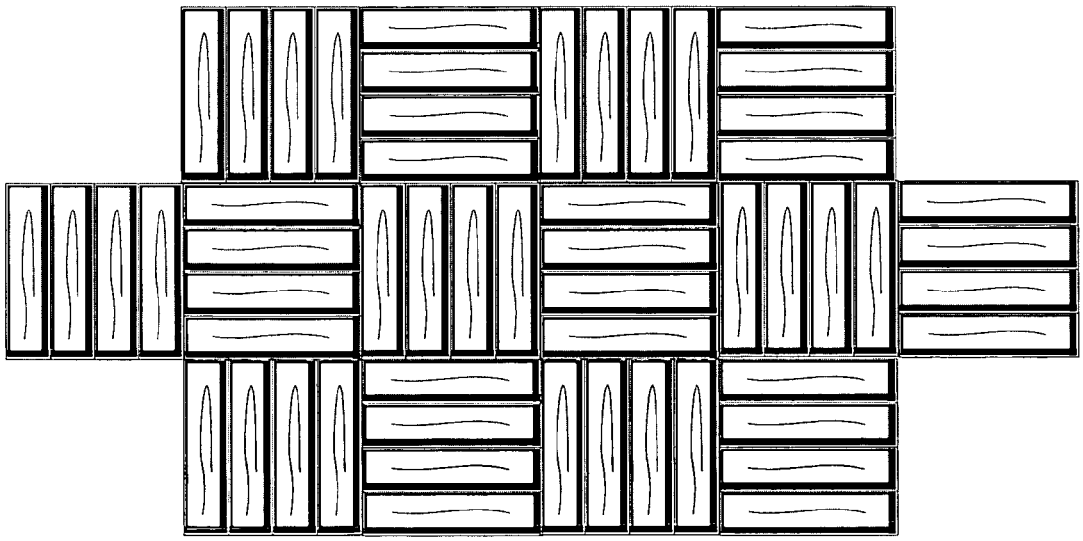

FIG. 7*a* shows two floor elements 1, 1' with mirror inverted locking systems. The panels are generally referred to as A and B panels. Both floor elements have a groove 9 on the same long edge but on different short edges. These two floor elements could be connected to floor panels 2, which are only of one type. This simplifies packaging and distribution. FIG. 7*b* shows the floor panels connected to a floor. These panels are preferably locked with angling or vertical folding.

Figure 8A:
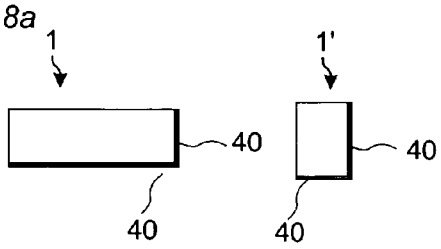
Figure 8B:
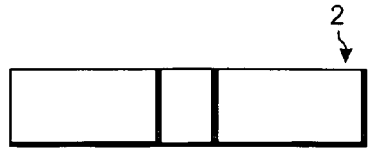
Figure 8C:
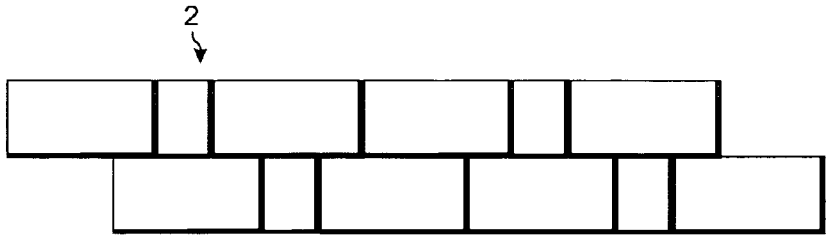

FIGS. 8*a*-8*c* show how two floor elements 1, 1' of different sizes could be factory connected to a floor panel 2. They are just as easy to install as traditional floor panels but the design is more advanced because different structures, designs and decorative grooves 40 could be combined and produced more efficient than with traditional technology.

Figure 8D:
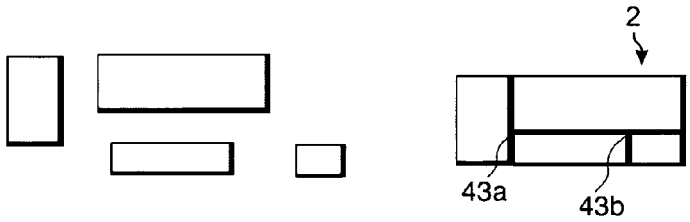
Figure 8E:
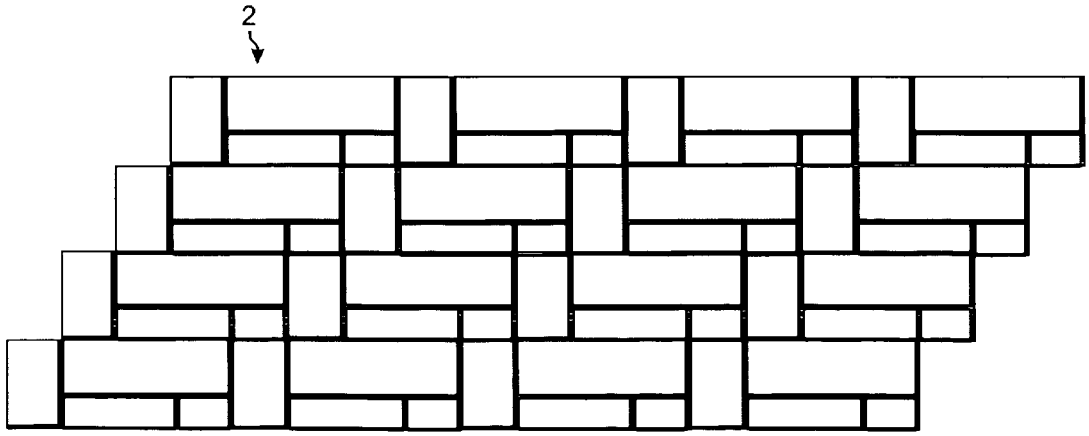

FIGS. 8*d*-*e* shows an even more advanced installation pattern with floor panels comprising four different floor elements with different sizes. The invention makes it possible to produce floor panels with decorative grooves between the edges of the panel and which meet each other in a T-shaped pattern 43*a*, 43*b*.

Figure 9A:
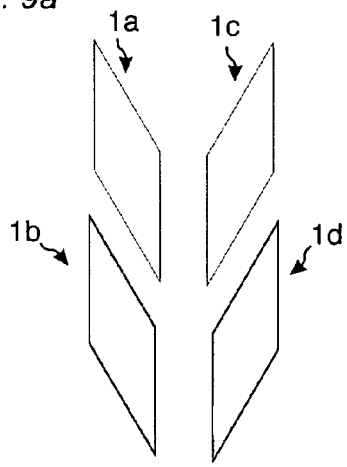
Figure 9B:
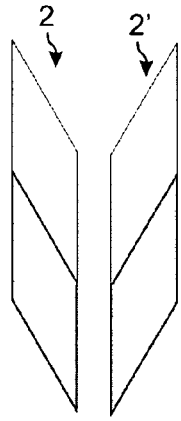
Figure 9C:
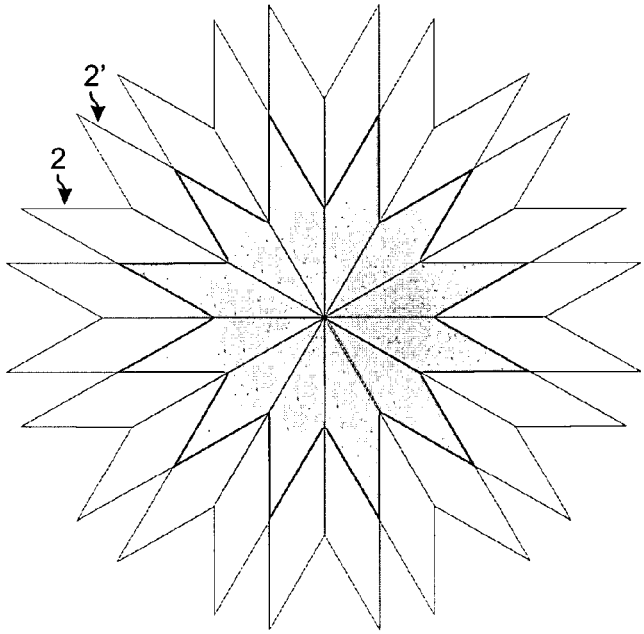

FIGS. 9*a*-9*c* show that very advanced star shaped floors could be produced and installed. Four floor elements 1*a*-1*d* could be connected to two different floor panels 2, 2' and connected to a star according to FIG. 9*c*. With modern production technology and appropriate locking systems, where angling and vertical folding is combined, it is possible to install floor panels easy to a star shaped floor that covers a large floor space for example 10*10 meters or more.

Figure 9D:
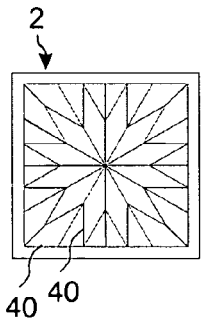
Figure 9E:
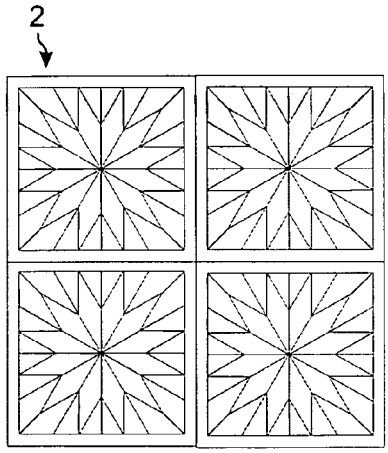

FIG. 9*d*-*e* show that very advanced floor panels 2 could be produced with floor elements of different shapes and sizes. The floor panels could comprise more than forty floor elements. All floor elements could have decorative grooves 40 or bevels. The joints between the floor elements could be glued in such a way that they could prevent moisture from penetrating trough the joint.

Figure 10A:
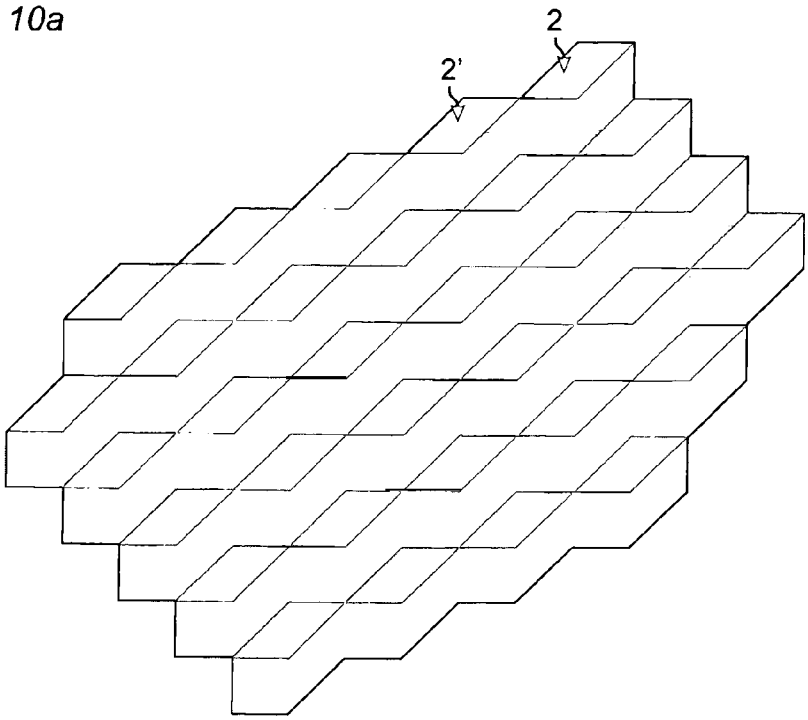
Figure 10B:
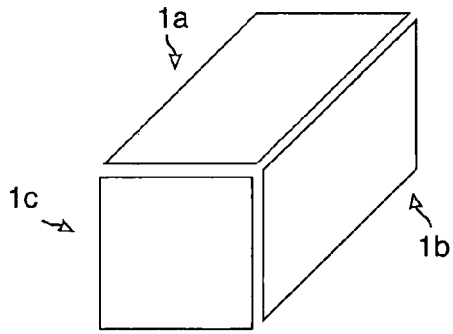
Figure 10C:
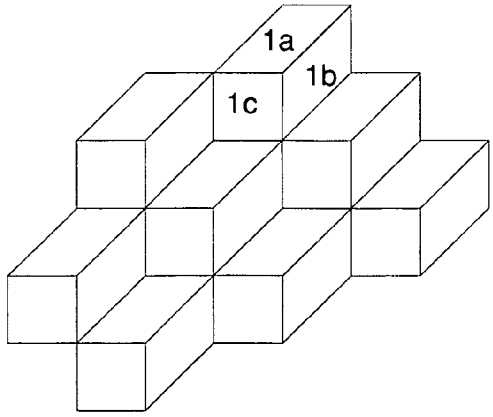

FIGS. 10*a*-10*c* show an embodiment of the invention involving a floor panel 2, which comprises a first 1*a* and a second 1*b* element shaped as a parallelogram, and a third quadratic panel 1*c*. FIG. 10*b* shows that the first 1*a* and the second elements 1*b* are mirror inverted and connected along adjacent edges and that the third quadratic element is connected to the edges of the first and second element, which are directed to each other. The floor panel is connected to essential identical floor panels 2', 2" with a combination of angling locking and/or flex tongue systems, as shown in FIG. 10*c*. Preferably the outer parallel edges of the first and second elements are provided with an angling locking system and the outer edges of the third element and its opposite outer edges of the first and second element are provided with a flex tongue system. FIG. 10*a* shows that if the element is coloured in different shades, and the floor panels are connected in a flooring installation, a three dimensional pattern is created.

These embodiments show that the invention makes it possible to connect floor element in a much simpler way and that the shape of the floor panel makes it possible to use other combinations of efficient and simple locking systems than what is possible with traditional locking technology based on individual floor element which are difficult to position and install.

The invention could be used to connect tile shaped panes installed on a wall or in furniture components.

Although only preferred embodiments are specifically illustrated and described herein, it will be appreciated that many modifications and variations of the present invention are possible in light of the above teachings and within the purview of the appended claims without departing from the spirit and intended scope of the invention.

The invention claimed is:

1. A flooring system, comprising a plurality of floor panels, each of the floor panels comprises at least two connected floor elements, such that each floor panel has a discontinuous core having a core joint and a discontinuous surface layer having a surface joint, said floor panels are mechanically connectable to each other along one pair of adjacent edges with a mechanical locking system adapted to mechanically lock the panels in the horizontal and vertical directions, the floor elements are factory connected to each other with a tongue and groove joint and glue and the surface joint is adjacent to the core joint.

2. The flooring system as claimed in claim 1, wherein at least one of the floor elements comprises a surface layer which is a printed layer.

3. The flooring system as claimed in claim 2, wherein at least one of the floor elements comprises a surface layer of laminate.

4. The flooring system as claimed in claim 1, wherein the floor elements comprise at least two pairs of adjacent edges which are glued together with a moisture-proof glue.

5. The flooring system as claimed in claim 1, wherein each of the floor panels comprises floor elements of different sizes.

6. The flooring system as claimed in claim 1, wherein the floor panel comprises at least three floor elements and at least two floor elements are of different sizes.

7. The flooring system as claimed claim 1, wherein adjacent floor panels have one pair of adjacent edges which are provided with an angling locking system, where an edge of a first floor panel is pressed against an upper part of an edge of a second floor panel and the first floor panel is angled down.

8. The flooring system as claimed in claim 7, wherein the adjacent floor panels have a second pair of adjacent edges which are provided with a vertical folding locking system.

9. The flooring system as claimed in claim 7, wherein the adjacent floor panels have at least one edge with a separate flexible tongue, wherein the flexible tongue has an inner part mounted in an open groove in the edge and a protruding part, wherein at least a part of the flexible tongue is resiliently displaceable in the open groove.

10. The flooring system as claimed in claim 7, wherein the adjacent floor panels have one pair of adjacent edges which is provided with a horizontal snapping or vertical folding system.

11. The flooring system as claimed in claim 1, wherein the surface layer comprises at least two different materials, such that the surface layer of one floor element comprises a different material than the surface layer of a second floor element.

12. The flooring system as claimed in claim 11, wherein one of the different materials is wood.

13. The flooring system as claimed in claim 11, wherein one of the materials is a laminate layer.

14. The flooring system as claimed in claim 1, wherein the surface layer is a thermoplastic material.

15. The flooring system as claimed in claim 1 , wherein the surface layer is wood.

16. The flooring system as claimed in claim 1, wherein the core is made of a wood fiber based sheet.

17. The flooring system as claimed in claim 1, wherein the core is made of High Density Fibreboard.

18. The flooring system as claimed in claim 1, wherein the floor panel comprises an underlay material and the floor elements are glued to the underlay material.

19. The flooring system as claimed in claim 1, wherein the connected floor elements constitute a visible pattern on an upper surface of the floor panel.

20. The flooring system as claimed in claim 1, wherein the floor panels are identical.

21. The flooring system as claimed in claim 1, wherein the adjacent floor panels have at least one edge with a separate flexible tongue, wherein the flexible tongue has an inner part mounted in an open groove in the edge and a protruding part, wherein at least a part of the flexible tongue is resiliently displaceable in the open groove.

22. The flooring system as claimed in claim 1, wherein the adjacent floor panels have one pair of adjacent edges which is provided with a horizontal snapping or vertical folding system.

23. A flooring system comprising a plurality of floor panels, each of the floor panels comprises at least two floor elements factory connected to each other via a tongue and groove joint and glue, such that each floor panel has a discontinuous core having a core joint and a discontinuous surface layer having a surface joint, said floor panels are mechanically connectable to each other along one pair of adjacent edges with a mechanical locking system adapted to mechanically lock the panels in the horizontal and vertical directions, wherein at least two floor elements have a decorative groove on at least one edge and at least two decorative grooves meet each other in a T shaped pattern spaced from the panel edge.

24. A flooring system comprising a plurality of floor panels, each of the floor panels comprises at least two floor elements each shaped as a parallelogram and a third floor element shaped as quadratic panel, the floor elements factory connected to each other via a tongue and groove joint and glue, such that each floor panel has a discontinuous core having a core joint and a discontinuous surface layer having a surface joint, said floor panels are mechanically connectable to each other along one pair of adjacent edges with a mechanical locking system adapted to mechanically lock the panels in the horizontal and vertical directions.

25. A flooring system comprising a plurality of floor panels, each of the floor panels comprises at least two floor elements each shaped as a parallelogram and factory connected to each other via a tongue and groove joint and glue, such that each floor panel has a discontinuous core having a core joint and a discontinuous surface layer having a surface joint, said floor panels are mechanically connectable to each other along one pair of adjacent edges with a mechanical locking system adapted to mechanically lock the panels in the horizontal and vertical directions, wherein the two factory connected floor elements form ⅙ of a center of a star shaped pattern.

* * * * *